US009485600B2

(12) United States Patent
Nakano

(10) Patent No.: US 9,485,600 B2
(45) Date of Patent: Nov. 1, 2016

(54) AUDIO SYSTEM, AUDIO SIGNAL PROCESSING DEVICE AND METHOD, AND PROGRAM

(75) Inventor: Kenji Nakano, Kanagawa (JP)

(73) Assignee: Sony Corporation, Tokyo (JP)

( * ) Notice: Subject to any disclaimer, the term of this patent is extended or adjusted under 35 U.S.C. 154(b) by 830 days.

(21) Appl. No.: 13/312,376

(22) Filed: Dec. 6, 2011

(65) Prior Publication Data

US 2012/0155681 A1 Jun. 21, 2012

(30) Foreign Application Priority Data

Dec. 16, 2010 (JP) ..... P2010-280165

(51) Int. Cl.

| | |
|---|---|
| ***H04R 5/00*** | (2006.01) |
| ***H04S 1/00*** | (2006.01) |
| ***H04S 5/02*** | (2006.01) |
| ***H04R 5/02*** | (2006.01) |
| *H04R 3/14* | (2006.01) |

(52) U.S. Cl.

CPC ..... *H04S 1/002* (2013.01); *H04R 5/02* (2013.01); *H04S 5/02* (2013.01); *H04R 3/14* (2013.01); *H04R 2205/024* (2013.01)

(58) Field of Classification Search

CPC .... H04S 1/002; H04S 2420/01; H04S 3/002; H04S 5/02; H04S 7/302; H04S 7/30; H04S 2420/07

See application file for complete search history.

(56) References Cited

U.S. PATENT DOCUMENTS 3,236,949 A * 2/1966 Atal et al. ..... 381/1
5,068,897 A 11/1991 Yamato et al.
5,657,391 A * 8/1997 Jyosako ..... 381/1
5,862,227 A * 1/1999 Orduna-Bustamante et al. ..... 381/17
6,222,930 B1 * 4/2001 Nakano et al. ..... 381/307
7,801,312 B2 * 9/2010 Kasai et al. ..... 381/17
8,116,458 B2 * 2/2012 Mizuno et al. ..... 381/18

(Continued)

FOREIGN PATENT DOCUMENTS

CN 101009953 8/2007
DE 2941692 10/1979

(Continued)

OTHER PUBLICATIONS

Smith, Julius O. Introduction to Digital Filters: With Audio Applications. W3K, 2008. pp. 109-111.*

(Continued)

*Primary Examiner* — Duc Nguyen
*Assistant Examiner* — Kile Blair
(74) *Attorney, Agent, or Firm* — Paratus Law Group, PLLC

(57) ABSTRACT

An audio system including a first speaker and a second speaker that are arranged in front of a predetermined listening position to be substantially bilaterally symmetrical with respect to the listening position; a third speaker and a fourth speaker that are arranged in front of the predetermined listening position to be substantially bilaterally symmetrical with respect to the listening position; a first attenuator that attenuates components that are equal to or less than a predetermined first frequency of an input audio signal; and an output controller that outputs sounds that are based on the input audio signal from the first speaker and the second speaker and outputs sounds that are based on the first audio signal in which components that are equal to or less than the first frequency of the input audio signal from the third speaker and the fourth speaker.

11 Claims, 9 Drawing Sheets

(56) References Cited

U.S. PATENT DOCUMENTS

| | | | | |
|---|---|---|---|---|
| 2007/0147636 | A1 | 6/2007 | Oteki | |
| 2007/0165890 | A1* | 7/2007 | Fusakawa et al. | 381/309 |
| 2008/0152152 | A1 | 6/2008 | Kimura | |
| 2010/0262419 | A1* | 10/2010 | De Bruijn | G10L 15/1822 704/9 |
| 2013/0121516 | A1* | 5/2013 | Lamb et al. | 381/307 |

FOREIGN PATENT DOCUMENTS

| | | |
|---|---|---|
| EP | 06-37191 | 2/1995 |
| JP | 55-077295 | 6/1980 |
| JP | 01 -272299 | 10/1989 |
| JP | 3900208 | 1/2007 |
| WO | WO2009/078176 A1 | 6/2009 |

OTHER PUBLICATIONS

Jun. 30, 2015, CN communication issued for related JP application No. 201110410168.6.

Apr. 2, 2014, EP communication issued for related EP application No. 11192768.7.

Oct. 2, 2014, JP communication issued for related JP application No. 2010-280165.

* cited by examiner

AUDIO SYSTEM, AUDIO SIGNAL PROCESSING DEVICE AND METHOD, AND PROGRAM

BACKGROUND

The present disclosure relates to an audio system, an audio signal processing device and method, and a program, and particularly relates to an audio system in which the sense of depth of sounds is enriched, an audio signal processing device and method, and a program.

In the related art, in the world of audio, various types of surround system techniques for realizing so-called stereophony have been proposed (for example, Japanese Patent No. 3900208) and popularized in ordinary homes.

On the other hand, in the world of video, accompanying the popularization of 3D television sets in recent years, it is predicted that content for reproducing so-called stereoscopic images (hereinafter, referred to as stereoscopic image content) will be popularized in ordinary homes.

SUMMARY

The audio signal that is incidental to such stereoscopic image content is an audio signal of a format of the related art such as the 5.1 channel system or the 2 channel (stereo) system. For such a reason, there are often cases when the audio effect in relation to the stereoscopic image protruding forward or recessing backward is insufficient.

For example, the audio image of sounds that are recorded from a sound source near the microphone (hereinafter, referred to as front side sounds) is not positioned to the front of the speaker (side closer to the listener) but is positioned between adjacent speakers or in the vicinity thereof. Further, the audio image of sounds that are recorded from a sound source that is far away from the microphone (hereinafter, referred to as depth side sounds) is not positioned behind the speaker (side further from the listener) either but is positioned at approximately the same position as that of the audio image of the front side sounds. The reason is that with content of movies or the like with an unspecified number of audience members, the position of the audio image is often controlled by the volume balance between speakers, and, as a result, the audio image is positioned between speakers even in the environment of an ordinary home. As a result, the sense of sound field becomes flat and the sense of depth becomes poor compared to the stereoscopic image.

It is desirable to enrich the sense of depth of sounds.

An audio system according to a first embodiment of the disclosure includes a first speaker and a second speaker that are arranged in front of a predetermined listening position to be substantially bilaterally symmetrical with respect to the listening position; a third speaker and a fourth speaker that are arranged in front of the predetermined listening position to be substantially bilaterally symmetrical with respect to the listening position such that, in a case when the listening position is the center, a center angle that is formed by connecting the listening position with each speaker is greater than a center angle that is formed by connecting the listening position with the first speaker and the second speaker and to be nearer the listening position than the first speaker and the second speaker in the longitudinal direction of the listening position; a first attenuator that attenuates components that are equal to or less than a predetermined first frequency of an input audio signal; and an output controller that controls to output sounds that are based on the input audio signal from the first speaker and the second speaker and to output sounds that are based on the first audio signal in which components that are equal to or less than the first frequency of the input audio signal from the third speaker and the fourth speaker.

A second attenuator that attenuates components that are equal to or greater than a predetermined second frequency of the input audio signal may be further included, wherein the output controller controls to output sounds that are based on a second audio signal in which components that are equal to or greater than the second frequency of the input audio signal from the first speaker and the second speaker.

The first to fourth speakers may be arranged such that the distance between the third speaker and the listening position and the distance between the fourth speaker and the listening position are less than the distance between the first speaker or the listening position or the distance between the second speaker and the listening position.

A signal processor that performs predetermined signal processing with respect to the first audio signal such that sounds based on the first audio signal are output virtually from the third speaker which is a virtual speaker and the fourth speaker which is a virtual speaker may be further included.

An audio signal processing device according to a second embodiment of the disclosure includes an attenuator that attenuates components of an input audio signal that are equal to or less than a predetermined frequency; and an output controller that controls to output sounds that are based on the input audio signal from a first speaker and a second speaker that are arranged in front of a predetermined listening position to be substantially bilaterally symmetrical to the listening position, and to output, in a case when the listening position is the center, sounds that are based on an audio signal in which components that are equal to or less than the predetermined frequency of the input audio signal from a third speaker and a fourth speaker are attenuated when the third speaker and the fourth speaker are arranged in front of the listening position to be substantially bilaterally symmetrical with respect to the listening position such that a center angle that is formed by connecting the listening position with the third speaker and the fourth speaker is greater than a center angle that is formed by connecting the listening position with the first speaker and the second speaker and to be nearer the listening position than the first speaker and the second speaker in the longitudinal direction of the listening position.

An audio signal processing method according to the second embodiment of the disclosure includes attenuating components of an input audio signal that are equal to or less than a predetermined frequency; and controlling to output sounds that are based on the input audio signal from a first speaker and a second speaker that are arranged in front of a predetermined listening position to be substantially bilaterally symmetrical to the listening position, and to output, in a case when the listening position is the center, sounds that are based on an audio signal in which components that are equal to or less than the predetermined frequency of the input audio signal from a third speaker and a fourth speaker are attenuated when the third speaker and the fourth speaker are arranged in front of the listening position to be substantially bilaterally symmetrical with respect to the listening position such that a center angle that is formed by connecting the listening position with the third speaker and the fourth speaker is greater than a center angle that is formed by connecting the listening position with the first speaker and the second speaker and to be nearer the listening position than the first speaker and the second speaker in the longitudinal direction of the listening position.

A program according to the second embodiment of the disclosure causes a computer to execute a process of attenuating components of an input audio signal that are equal to or less than a predetermined frequency; and controlling to output sounds that are based on the input audio signal from a first speaker and a second speaker that are arranged in front of a predetermined listening position to be substantially bilaterally symmetrical to the listening position, and to output, in a case when the listening position is the center, sounds that are based on an audio signal in which components that are equal to or less than the predetermined frequency of the input audio signal from a third speaker and a fourth speaker are attenuated when the third speaker and the fourth speaker are arranged in front of the listening position to be substantially bilaterally symmetrical with respect to the listening position such that a center angle that is formed by connecting the listening position with the third speaker and the fourth speaker is greater than a center angle that is formed by connecting the listening position with the first speaker and the second speaker and to be nearer the listening position than the first speaker and the second speaker in the longitudinal direction of the listening position.

In the first embodiment or the second embodiment of the disclosure, components of an input audio signal that are equal to or less than a predetermined frequency are attenuated, sounds that are based on the input audio signal from a first speaker and a second speaker that are arranged in front of a predetermined listening position to be substantially bilaterally symmetrical to the listening position are output, and in a case when the listening position is the center, sounds that are based on an audio signal in which components that are equal to or less than the predetermined frequency of the input audio signal from a third speaker and a fourth speaker are attenuated when the third speaker and the fourth speaker are arranged in front of the predetermined listening position to be substantially bilaterally symmetrical with respect to the listening position such that a center angle that is formed by connecting the listening position with the third speaker and the fourth speaker is greater than a center angle that is formed by connecting the listening position with the first speaker and the second speaker and to be nearer the listening position than the first speaker and the second speaker in the longitudinal direction of the listening position are output.

According to the first embodiment or the second embodiment of the disclosure, the sense of depth of sounds is able to be enriched.

DETAILED DESCRIPTION OF EMBODIMENTS

Embodiments of the disclosure will be described below. Here, description will be given in the following order.

1. First Embodiment (Example Using Virtual Speaker)
2. Second Embodiment (Example Using Actual Speaker)
3. Modified Examples

1. First Embodiment

Configuration Example of Audio System

Figure 1:
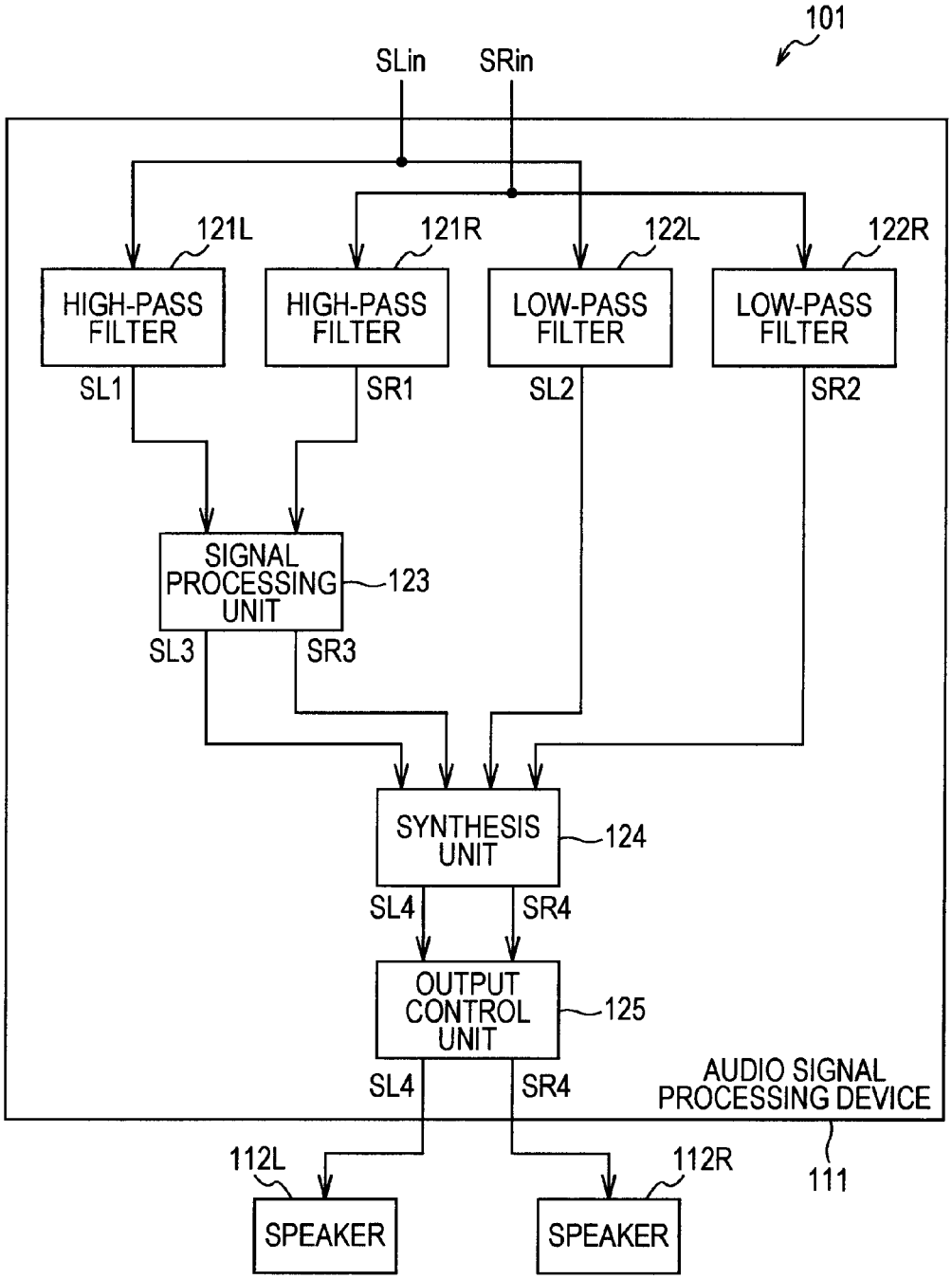
FIG. 1 is a block diagram of a first embodiment of an audio system to which the embodiments of the disclosure are applied.

FIG. 1 is a block diagram of a first embodiment of an audio system to which the embodiments of the disclosure are applied.

Au audio system 101 of FIG. 1 is configured to include an audio signal processing device 111 and speakers 112L and 112R.

The audio signal processing device 111 is a device that enriches the sense of depth of sounds that are output from the speakers 112L and 112R by performing predetermined signal processing on stereo audio signals composed of audio signals SLin and SRin.

The audio signal processing device 111 is configured to include high-pass filters 121L and 121R, low-pass filter 122L and 122R, a signal processing unit 123, a synthesis unit 124, and an output control unit 125.

The high-pass filter 121L extracts high-pass components of the audio signal SLin by attenuating components that are equal to or less than a predetermined frequency of the audio signal SLin. The high-pass filter 121L supplies an audio signal SL1 composed of the extracted high-pass components to the signal processing unit 123.

The high-pass filter 121R has approximately the same frequency characteristics as the high-pass filter 121L, and extracts high-pass components of the audio signal SRin by attenuating components that are equal to or less than a predetermined frequency of the audio signal SRin. The high-pass filter 121R supplies an audio signal SR1 composed of the extracted high-pass components to the signal processing unit 123.

The low-pass filter 122L extracts low-mid-pass components of the audio signal SLin by attenuating components that are equal to or greater than a predetermined frequency of the audio signal SLin. The low-pass filter 122L supplies an audio signal SL2 composed of the extracted low-mid-pass components to the synthesis unit 124.

The low-pass filter 122R has approximately the same frequency characteristics as the low-pass filter 122L, and extracts low-mid-pass components of the audio signal SRin by attenuating components that are equal to or greater than a predetermined frequency of the audio signal SRin. The low-pass filter 122R supplies an audio signal SR2 composed of the extracted low-mid-pass components to the synthesis unit 124.

Here, the frequency characteristics in which the frequency characteristics of the high-pass filter 121L and the low-pass filter 122L and the frequency characteristics in which the frequency characteristics of the high-pass filter 121R and the low-pass filter 122R are respectively approximately flat.

Figure 2:
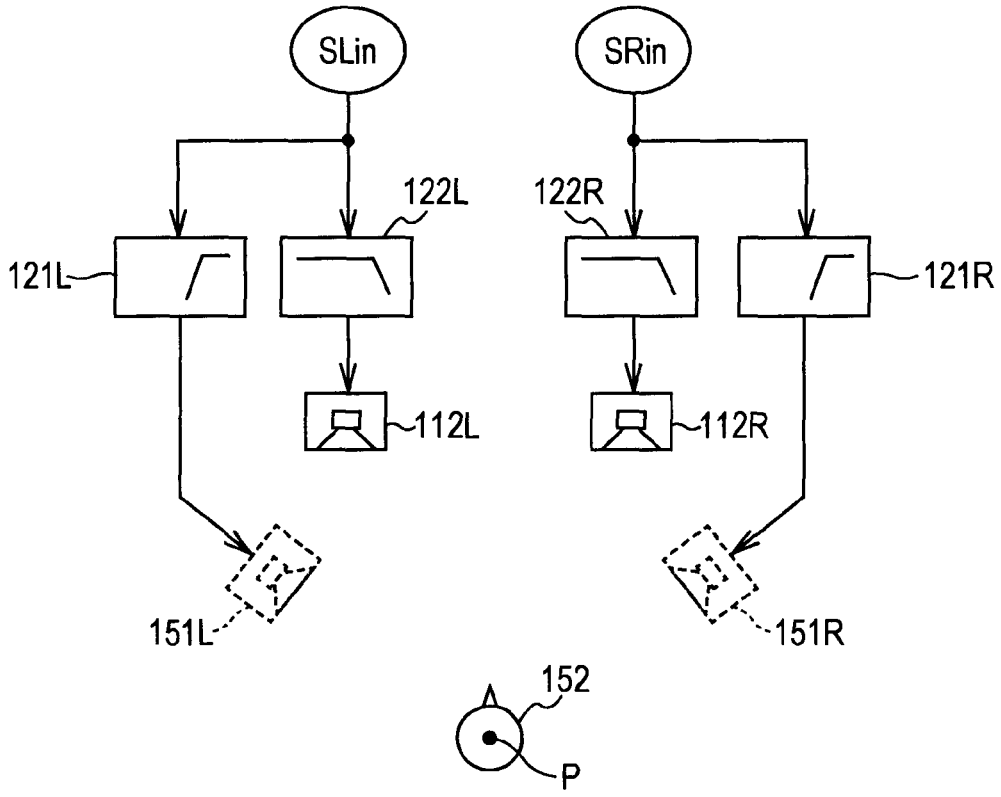
FIG. 2 is a diagram that illustrates the position of virtual speakers.

The signal processing unit 123 performs predetermined signal processing on the audio signal SL1 and the audio signal SR1 such that sounds based on the audio signal SL1 and the audio signal SR1 are output virtually from virtual speakers 151L and 151R illustrated in FIG. 2. The signal processing unit 123 supplies audio signals SL3 and SR3 that are obtained as a result of the signal processing to the synthesis unit 124.

Here, the vertical direction of FIG. 2 is the longitudinal direction of a predetermined listening position P, and the horizontal direction of FIG. 2 is the horizontal direction of the listening position P. Further, the upward direction of FIG. 2 is the front side of the listening position P, that is the front side of a listener 152 who is at the listening position P, and the downward direction of FIG. 2 is the back side of the listening position P, that is, the rear side of the listener 152. Further, the longitudinal direction of the listening position P is hereinafter also referred to as the depth direction.

The synthesis unit 124 generates an audio signal SL4 by synthesizing the audio signal SL2 and the audio signal SL3, and generates an audio signal SR4 by synthesizing the audio signal SR2 and the audio signal SR3. The synthesis unit 124 supplies the audio signal SL4 and SR4 to the output control unit 125.

The output control unit 125 performs output control to output the audio signal SL4 to the speaker 112L and to output the audio signal SR4 to the speaker 112R.

The speaker 112L outputs sounds that are based on the audio signal SL4 and the speaker 112R outputs sounds that are based on the audio signal SR4.

Figure 6:
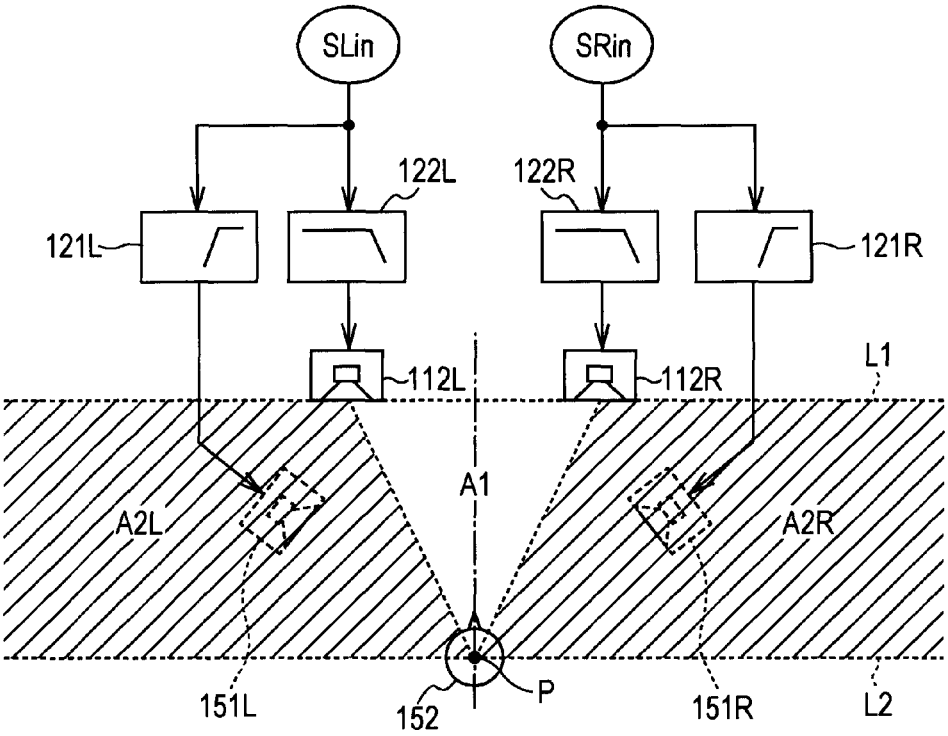
FIG. 6 is a diagram that illustrates a first example of the arrangement conditions of speakers and virtual speakers.

Here, although the details will be described later with reference to FIGS. 6 and 7, the speakers 112L and 112R and the virtual speaker 151L and 151R are arranges to satisfy the following Conditions 1 to 3.

Condition 1: the speaker 112L and the speaker 112R, and the virtual speaker 151L and the virtual speaker 151R are respectively approximately bilaterally symmetrical with respect to the listening position P in front of the listening position P.

Condition 2: The virtual speakers 151L and 151R are closer to the listening position P in the depth direction than the speakers 112L and 112R. In so doing, the audio image of by the virtual speakers 151L and 151R is positioned at a position that is nearer the listening position P in the depth direction than the audio image by the speakers 112L and 112R.

Condition 3: in a case when the listening position P is the center, a center angle that is formed by connecting the listening position with the virtual speaker 151L and the virtual speaker 151R is greater than a center angle that is formed by connecting the listening position P with the speaker 112L and the speaker 112R. In so doing, sounds that are output virtually from the virtual speakers 151L and 151R reach the listening position P further from the outside than sounds that are output from the speakers 112L and 112R.

Here, the listening position P is an ideal listening position that is set in order to design the audio system 101.

[Audio Signal Processing]

Figure 3:
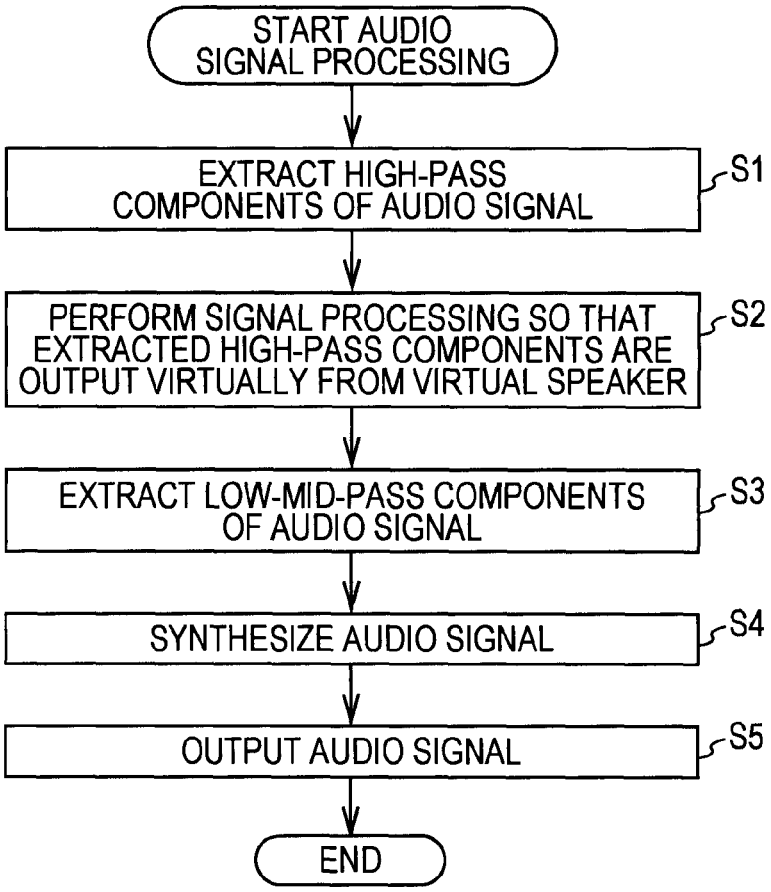
FIG. 3 is a flowchart for describing audio signal processing that is executed by the audio system.

Next, the audio signal processing that is executed by the audio system 101 will be described with reference to the flowchart of FIG. 3. Here, such process is started when the input of an audio signal to the audio signal processing device 111 is started and ended when the input of the audio signal to the audio signal processing device 111 is stopped.

The high-pass filters 121L and 121R extract the high-pass components of the audio signal in step S1. That is, the high-pass filter 121L extracts the high-pass components of the audio signal SLin and supplies the audio signal SL1 composed of the extracted high-pass components to the signal processing unit 123. Further, the high-pass filter 121R extracts the high-pass components of the audio signal SRin and supplies the audio signal SR1 composed of the extracted high-pass components to the signal processing unit 123.

The signal processing unit 123 performs signal processing so that the extracted high-pass components are output virtually from virtual speakers in step S2. That is, the signal processing unit 123 performs predetermined signal processing on the audio signals SL1 and SR1 so that when the sounds that are based on the audio signals SL1 and SR1 are output from the speakers 112L and 112R, the listener 152 auditorily perceives the sounds as if the sounds are output from the virtual speakers 151L and 151R. In other words, the signal processing unit 123 performs predetermined signal processing on the audio signals SL1 and SR1 so that the virtual sound source of the sounds that are based on the audio signals SL1 and SR1 are the positions of the virtual speakers 151L and 151R. Furthermore, the signal processing unit 123 supplies the obtained audio signals SL3 and SR3 to the synthesis unit 124.

Here, an arbitrary technique may be adopted for the signal processing that is performed at such a point. Here, one example thereof will be described.

First, the signal processing unit 123 performs binauralization processing on the audio signals SL1 and SR1. Specifically, the signal processing unit 123 actually arranges a speaker at the position of the virtual speaker 151L and when the audio signal SL1 is output therefrom, generates a signal that reaches the left and right ears of the listener 152 who is at the listening position P. That is, the signal processing unit 123 performs a process of operating to superimpose a head-related transfer function (HRTF) from the position of the virtual speaker 151L to the ears of the listener 152 on the audio signal SL1.

The head-related transfer function is an audio impulse response from a position at which an audio image is to be felt by the listener to the ears of the listener. A head-related transfer function HL to the left ear of the listener and a head-related transfer function HR to the right ear are present for one listening position. Furthermore, if the head-related transfer functions that relate to the position of the virtual speaker 151L are respectively HLL and HLR, an audio signal SL1Lb that corresponds to direct sounds that reach the left ear of the listener directly is obtained by superimposing the head-related transfer function HLL on the audio signal SL1. Similarly, an audio signal SL1Rb that corresponds to direct sounds that reach the right ear of the listener directly is obtained by superimposing the head-related transfer function HLR on the audio signal SL1. Specifically, the audio signals SL1Lb and SL1Rb are ascertained by the following Equations 1 and 2.

$$SL1Lb[n] = \sum_{m=0}^{dLL} (SL1[n-m] * HLL[m]) \tag{1}$$

$$SL1Rb[n] = \sum_{m=0}^{dLR} (SL1[n-m] * HLR[m]) \tag{2}$$

Here, n is the number of samples, dLL represents the next number of the head-related transfer function HLL and dLR represents the next number of the head-related transfer function HLR.

Similarly, the signal processing unit 123 actually arranges a speaker at the position of the virtual speaker 151R and when the audio signal SR1 is output therefrom, generates a signal that reaches the left and right ears of the listener 152 who is at the listening position P. That is, the signal processing unit 123 performs a process of operating to superimpose a head-related transfer function (HRTF) from the position of the virtual speaker 151R to the ears of the listener 152 on the audio signal SR1.

That is, if the head-related transfer functions that relate to the position of the virtual speaker 151R are respectively HRL and HRR, an audio signal SR1Lb that corresponds to direct sounds that reach the left ear of the listener directly is obtained by superimposing the head-related transfer function HRL on the audio signal SR1. Similarly, an audio signal SR1Rb that corresponds to direct sounds that reach the right ear of the listener directly is obtained by superimposing the head-related transfer function HRR on the audio signal SR1. Specifically, the audio signals SR1Lb and SR1Rb are ascertained by the following Equations 3 and 4.

$$SR1Lb[n] = \sum_{m=0}^{dRL} (SR1[n-m] * HRL[m]) \tag{3}$$

$$SR1Rb[n] = \sum_{m=0}^{dRR} (SR1[n-m] * HRR[m]) \tag{4}$$

Here, dRL represents the next number of the head-related transfer function and dRR represents the next number of the head-related transfer function HRR.

A signal in which the audio signal SL1Lb and the audio signal SR1Lb ascertained in such a manner are added as in Equation 5 below is an audio signal SLb. Further, a signal in which the audio signal SL1Rb and the audio signal SR1Rb are added as in Equation 6 below is an audio signal SRb.

$$SLb[n]=SL1Lb[n]+SR1Lb[n] \tag{5}$$

$$SRb[n]=SL1Rb[n]+SR1Rb[n] \tag{6}$$

Next, the signal processing unit 123 executes a process of removing crosstalk (crosstalk canceller) that is for speaker reproduction from the audio signal SRb and the audio signal SLb. That is, the signal processing unit 123 processes the audio signals SLb and SRb such that the sounds based on the audio signal SLb reach only the left ear of the listener 152 and the sounds based on the audio signal SRb reach only the right ear of the listener 152. The audio signals that are obtained as a result are the audio signals SL3 and SR3.

In step S3, the low-pass filters 122L and 122R extract low-mid-pass components of image signals. That is, the low-pass filter 122L extracts the low-mid-pass components of the audio signal SLin and supplies the audio signal SL2 that is composed of the extracted low-mid-pass components to the synthesis unit 124. Further, the low-pass filter 122R extracts the low-mid-pass components of the audio signal SRin and supplies the audio signal SR2 composed of the extracted low-mid-pass components to the synthesis unit 124.

Here, the process of steps S1 and S2 and the process of step S3 are executed concurrently.

The synthesis unit 124 synthesizes audio signals in step S4. Specifically, the synthesis unit 124 synthesizes the audio signal SL2 and the audio signal SL3 and generates the audio signal SL4. Further, the synthesis unit 124 synthesizes the audio signal SR2 and the audio signal SR3 and generates the audio signal SR4. Furthermore, the synthesis unit 124 supplies the generated audio signals SL4 and SR4 to the output control unit 125.

The output control unit 125 outputs audio signals in step S5. Specifically, the output control unit 125 outputs the audio signal SL4 to the speaker 112L and output the audio signal SR4 to the speaker 112R. Furthermore, the speaker 112L outputs sounds that are based on the audio signal SL4 and the speaker 112R outputs sounds that are based on the audio signal SR4.

As a result, the listener 152 auditorily perceives that the sounds of the low-mid-pass components (hereinafter referred to as low-mid-pass sounds) that are extracted from the low-pass filters 122L and 122R are output from the speakers 112L and 112R, and that the sounds of the high-pass components (hereinafter referred to as high-pass sounds) that are extracted from the high-pass filters 121L and 121R are output from the virtual speakers 151L and 151R.

The audio signal processing is ended thereafter.

Effects of Embodiments of Disclosure

Here, the effects of the embodiments of the disclosure will be described with reference to FIGS. 4 and 5.

In general, with direct sounds that reach the microphone from the sound source directly, the closer the sound source to the microphone, the higher the level (sound pressure level or volume level), the further the sound source from the microphone, the lower the level. On the other hand, the level of indirect sounds that reach the microphone from the sound source indirectly by reflection or the like changes little by the distance between the sound source and the microphone in comparison to direct sounds.

Therefore, front side sounds that are emitted from a light source that is close to the microphone and which are sounds that are recorded on microphone (for example, a dialogue of a person or the like), as it is called, have a high proportion of direct sounds and a low proportion of indirect sounds. On the other hand, depth side sounds that are emitted from a light source that is far from the microphone and which are sounds that are recorded off-microphone (for example, a natural environment sound or the like), as it is called, have a high proportion of indirect sounds and a low proportion of direct sounds. Further, within the range of a certain distance, the further the sound source from the microphone, the greater the proportion of indirect sounds and the lower the proportion of direct sounds.

Incidentally, there is a case when, in movies or the like, for example, sounds are created as if recorded on a microphone before being mixed with other sounds in order to allow sound effects that are recorded on the microphone to be heard from afar.

Further, although also depending on the relation relationship between the level of the front side sounds and the level of the depth side sounds, in general, the front side sounds have a higher level than the depth side sounds.

Furthermore, the further the sound source from the microphone, the greater the tendency of the high-pass level to decrease. Therefore, although there is little drop in the level with the frequency distribution of the front side sounds, high-pass levels drop with the frequency distribution of the depth side sounds. As a result, when the front side sounds and the depth side sounds are compared, the level difference is relatively greater with high-pass than with low-mid-pass.

Further, as described above, as compared to indirect sounds, direct sounds have a greater decrease in the level with distance. Therefore, with depth side sounds, as compared to indirect sounds, direct sounds have a greater drop in the high-pass level. As a result, with the depth side sounds, the proportion of indirect sounds to direct sounds is relatively greater with high-pass than with low-mid-pass.

Furthermore, indirect sounds arrive from various directions at random times. Therefore, indirect sounds are sounds with low correlation between left and right.

Here, the physical characteristics of such front side sounds and depth side sounds and direct sounds and indirect sounds are saved approximately as are even with a sound format of the related art. For example, indirect sounds are included in multi-channel audio signals of 2 or more channels as components with a low correlative relationship between left and right.

As described above, the audio image of high-pass sounds (hereinafter referred to as high-pass audio image) that is output virtually from the virtual speakers 151L and 151R is positioned at a position that is closer in the depth direct to the listening position P than the audio image of low-mid-pass sounds (hereinafter referred to as low-mid-pass audio image) that is output from the speakers 112L and 112R.

Therefore, sounds with greater high-pass components have a greater effect of the high-pass sound image by the virtual speakers 151L and 151R on the listener 152 and the position of the audio image that the listener 152 perceives moves in a direction that is nearer the listener 152. Accordingly, the listener 152 perceives sounds with more high-pass components as emanating from nearby, and as a result, generally perceives the front side sounds that include more high-pass components as being nearer than depth side sounds with fewer high-pass components.

Further, it is recognized that the cross correlation of audio signals that reach both ears of the listener has an influence over the sense of distance of the audio image that the listener perceives.

Specifically, as one indicator that represents the cross correlation of audio signals that reach both ears, there is IACC (Inter-Aural Cross Correlation) that is used as a parameter that represents the sense of diffusion of sounds, the spatial awareness, and the like. IACC represents the maximum value of a cross correlation function that represents the difference between the audio signals that reach both ears within a range in which the delay time of the left and right audio signals is equal to or less than 1 msec.

Furthermore, it is recognized that, within a range in which the IACC is equal to or greater than 0, the smaller the IACC, that is, the smaller the correlation between the audio signals that enter the ears, the further the distance of the audio image that the listener perceives, and the further the sounds that are heard appear.

The IACC changes, for example, by the energy rate between direct sounds and indirect sounds (R/D ratio). That is, since indirect sounds have a low correlation between left and right as described above, the greater the R/D ratio, the smaller the IACC. Therefore, the greater the R/D ratio, the further the distance of the audio image that the listener perceives, and the further the sounds that are heard appear.

Here, for example, the energy of the direct sounds that reach the listener attenuates approximately in proportion to the square of the distance from the sound source. On the other hand, the attenuation rate of the distance of the energy of indirect sounds that reach the listener from the sound source is low compared to direct sounds. Such a case is also clear from the way that the further away the sound source is, the greater the energy rate between the direct sounds and the indirect sounds (R/D ratio).

Further, the IACC changes, for example, by the arrive direction of the indirect sounds.

Figure 4:
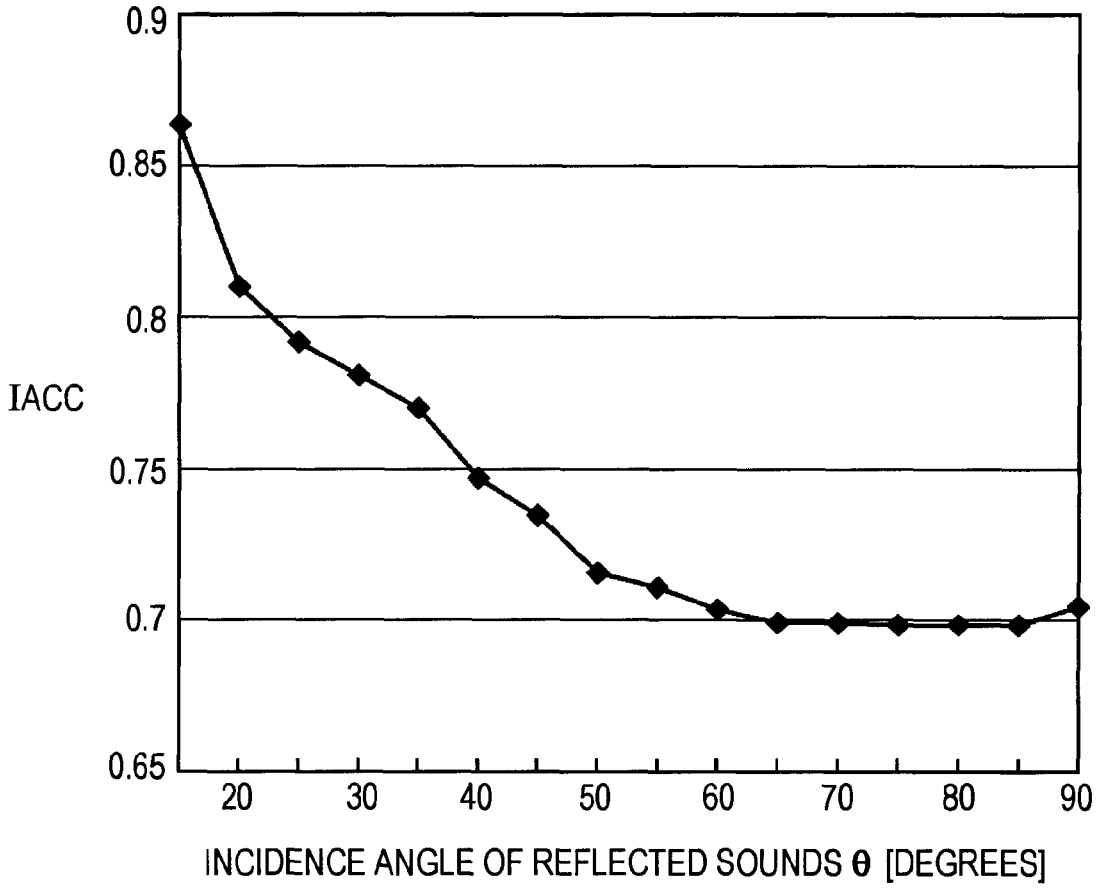
FIG. 4 is a graph that illustrates one example of a measurement result of IACC with respect to the incident angle of a reflected sound.
Figure 5:
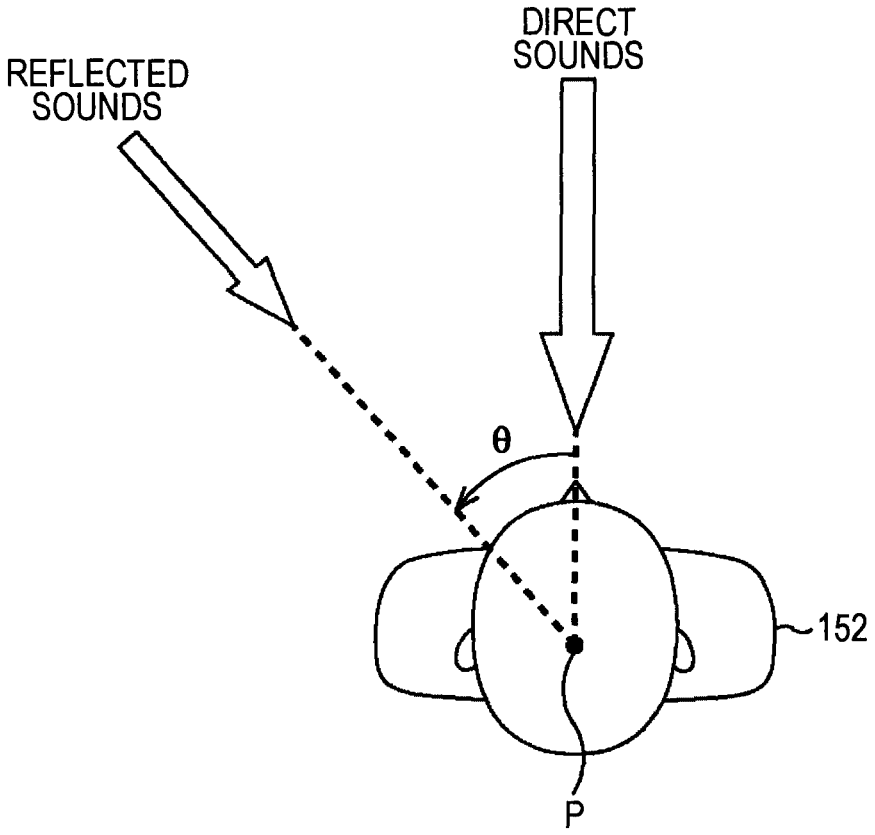
FIG. 5 is a diagram for describing the measurement conditions of IACC with respect to the incident angle of a reflected sound.

FIG. 4 illustrates one example of the result of measuring the IACC while changing, as illustrated in FIG. 5, the incidence angle θ in the horizontal direction of the reflected sounds (indirect sounds) of the direct sounds that arrive from in front of the listener 152. Here, the IACC of FIG. 4 is measure with the conditions of setting the amplitude of the reflected sounds to ½ that of the direct sounds and the reflected sounds reaching the ears of the listener 152 approximately 6 msec later than the direct sounds. Further, the horizontal axis of FIG. 4 indicates the incidence angle θ of the reflected sounds, and the vertical axis indicates the IACC.

It is seen from the measurement result that the greater the incidence angle θ of the reflected sounds, the weaker the IACC. That is, the difference in the arrival directions of the indirect sounds and the direct sounds increase, and the further the indirect sounds arrive from the side of the listener 152, the weaker the IACC. As a result, the distance of the audio image that the listener 152 perceives increases, and the sounds that are heard appear further. Such an effect has also been proven in auditory sense experiments by a plurality of listeners.

Here, the listener 152 perceives the high-pass sounds that are output virtually from the virtual speakers 151L and 151R to be arriving more from the outside than the low-mid-pass sounds that are output from the speakers 112L and 112R. Such high-pass sounds also include the high-pass components of indirect sounds.

Therefore, the greater the proportion of indirect sounds in sounds, the weaker the IACC, and the more the position of the audio image that the listener 152 perceives moves in a direction that is away from the listener 152. Accordingly, the listener 152 perceives sounds with a greater proportion of indirect sounds to be emanating from afar, and as a result, perceives the depth side sounds with a greater proportion of indirect sounds as being further away than front side sounds with a smaller proportion of indirect sounds.

In summary, due to the effects of a high-pass audio image by the virtual speakers 151L and 151R, the listener 152 perceives sounds that include more high-pass components as emanating from nearby. Further, due to the difference in the arrival direction of low-mid-pass sounds and high-pass sounds, the listener 152 perceives sounds that include more indirect sounds as emanating from afar.

As a result, the listener 152 perceives the audio image of front side sounds with more high-pass components and a low proportion of indirect sounds as being nearby, and perceives the audio image of depth side sounds with few high-pass components and a greater proportion of indirect sounds as being far away. Further, the positions of the audio images of each sound in the depth direction which the listener 152 perceives change according to the number of high-pass components and the proportion of indirect sounds that are included in each sound. Therefore, the audio images of each sound spread in the depth direction and the sense of depth that the listener 152 perceives is enriched.

Here, as represented by a loudness curve, in general, people are more sensitive to the sounds of high-pass components when the volume is high than sounds when the volume is low. Therefore, the effects of the front side sounds (usually high volume) that are brought about by the high-pass sounds that are output virtually from the virtual speakers 151L and 151R are emphasized by the loudness effect.

[Arrangement of Speakers and Virtual Speakers]

Next, an example of an arrangement of the speakers 112L and 112R and the virtual speakers 151L and 151R will be described with reference to FIGS. 6 and 7.

As described above, the speakers 112L and 112R and the virtual speakers 151L and 151R are arranged such that Conditions 1 to 3 are satisfied. FIG. 6 illustrates an example of an arrangement of the speakers 112L and 112R and the virtual speakers 151L and 151R such that such conditions are satisfied.

First, the speakers 112L and 112R are arranged to be approximately bilaterally symmetrical with respect to the listening position P in front of the listening position P.

Further, a straight line L1 in the drawings is a straight line that passes the front faces of the speakers 112L and 112R. A straight line L2 is a straight line that passes the listening position P and which is parallel to the straight line L1. A region A1 is a region that connects the speaker 112L, the speaker 112R, and the listening position P. A region A2L is a region between the straight lines L1 and L2 and to the left of the listening position P, and is a region that excludes the region A1. A region A2R is a region between the straight lines L1 and L2 and to the right of the listening position P, and is a region that excludes the region A1.

Further, by arranging the virtual speakers 151L within the region A2L and arranging the virtual speaker 151R within the region A2R to be approximately bilaterally symmetrical with respect to the listening position P, Condition 1 to 3 described above are able to be satisfied.

However, if the positions of the virtual speakers 151L and 151R are too far away from the speakers 112L and 112R, there is a concern that the time difference between the low-mid-pass sounds and the high-pass sounds that reach the ears of the listener 152 become too great and the listener 152 experiences discomfort.

Figure 7:
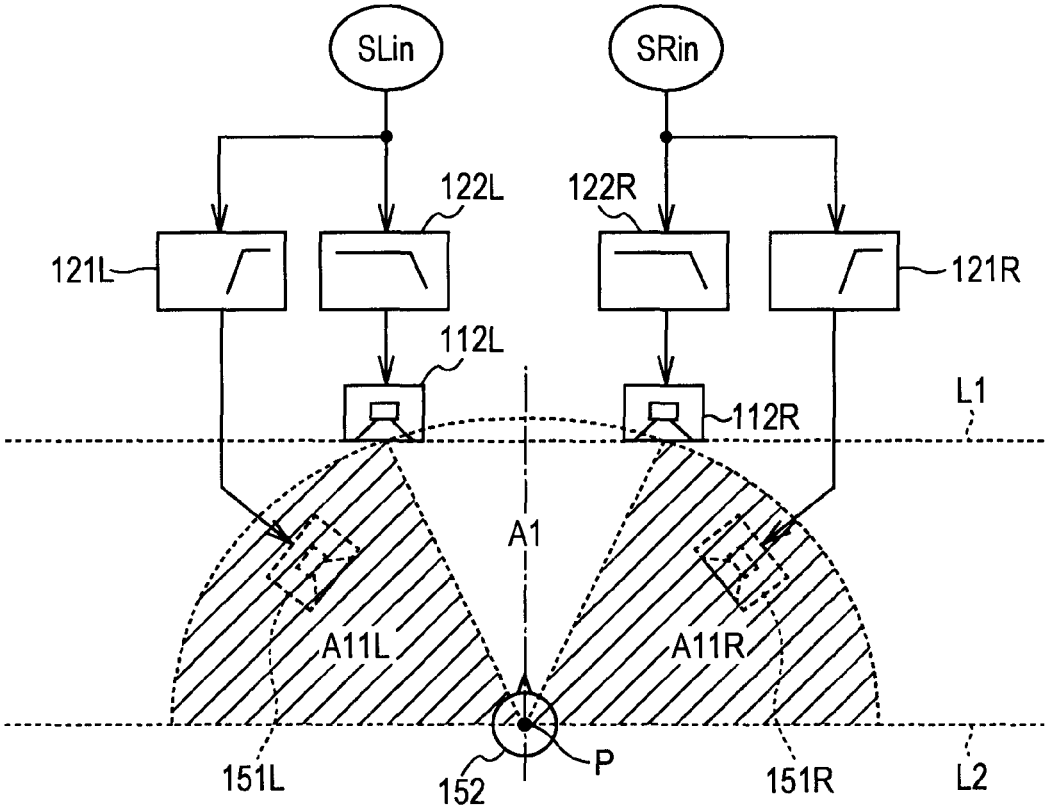
FIG. 7 is a diagram that illustrates a second example of the arrangement conditions of speakers and virtual speakers.

It is therefore desirable to further arrange the virtual speakers 151L and 151R within a region A11L and a region A11R of FIG. 7.

The region A11L is a region within the region A2L and in which the distance from the listening position P is within the range of the distance between the listening position P and the speaker 112L. The region A11L is therefore a fan-shaped region with the listening position P as the center and the distance between the listening position P and the speaker 112L as the radius. Further, the region A11R is a region within the region A2R and in which the distance from the listening position P is within the range of the distance between the listening position P and the speaker 112R. The region A11R is therefore a fan-shaped region with the listening position P as the center and the distance between the listening position P and the speaker 112R as the radius. Here, since the distance between the listening position P and the speaker 112L and the distance between the listening position P and the speaker 112R are approximately equal, the region A11L and the region A11R are approximately bilaterally symmetrical regions.

Furthermore, the virtual speaker 151L may be arranged within the region A11L and the virtual speaker 151R may be arranged within the region A11R to be approximately bilaterally symmetrical with respect to the listening position P. In so doing, the virtual speakers 151L and 151R are arranged closer to the listening position P than are the speakers 112L and 112R. In other words, the distance between the virtual speaker 151L and the listening position P and the distance between the virtual speaker 151R and the listening position P are less than the distance between the speaker 112L and the listening position P and the distance between the speaker 112R and the listening position P.

As a result, the time difference between the low-mid-pass sounds and the high-pass sounds that reach the ears of the listener 152 are prevented from becoming too great. Furthermore, by arranging the virtual speakers 151L and 151R to be closer to the listening position P than are the speakers 112L and 112R, a high-pass audio image by the virtual speakers 151L and 151R is able to be effected to the listener 152 advantageously over a low-mid-pass audio image by the speakers 112L and 112R due to the Haas effect. As a result, the audio image of the front side sounds is able to be positioned closer to the listener 152.

Here, if the virtual speakers 151L and 151R are too close to the region A1, the difference between the arrival directions of low-mid-pass sounds and high-pass sounds to the listening position P becomes small and the effect on the depth side sounds is reduced. Further, if the virtual speakers 151L and 151R are too close to the straight line L2, there is a concern that the distance between the high-pass audio image and the low-mid-pass audio image becomes too great and the listener 152 experiences discomfort. It is therefore desirable to arrange the virtual speakers 151L and 151R to be away from the region A1 and the straight line L2 as much as possible.

2. Second Embodiment

Next, a second embodiment of the disclosure will be described with reference to FIG. 8.

[Configuration Example of Audio System]

Figure 8:
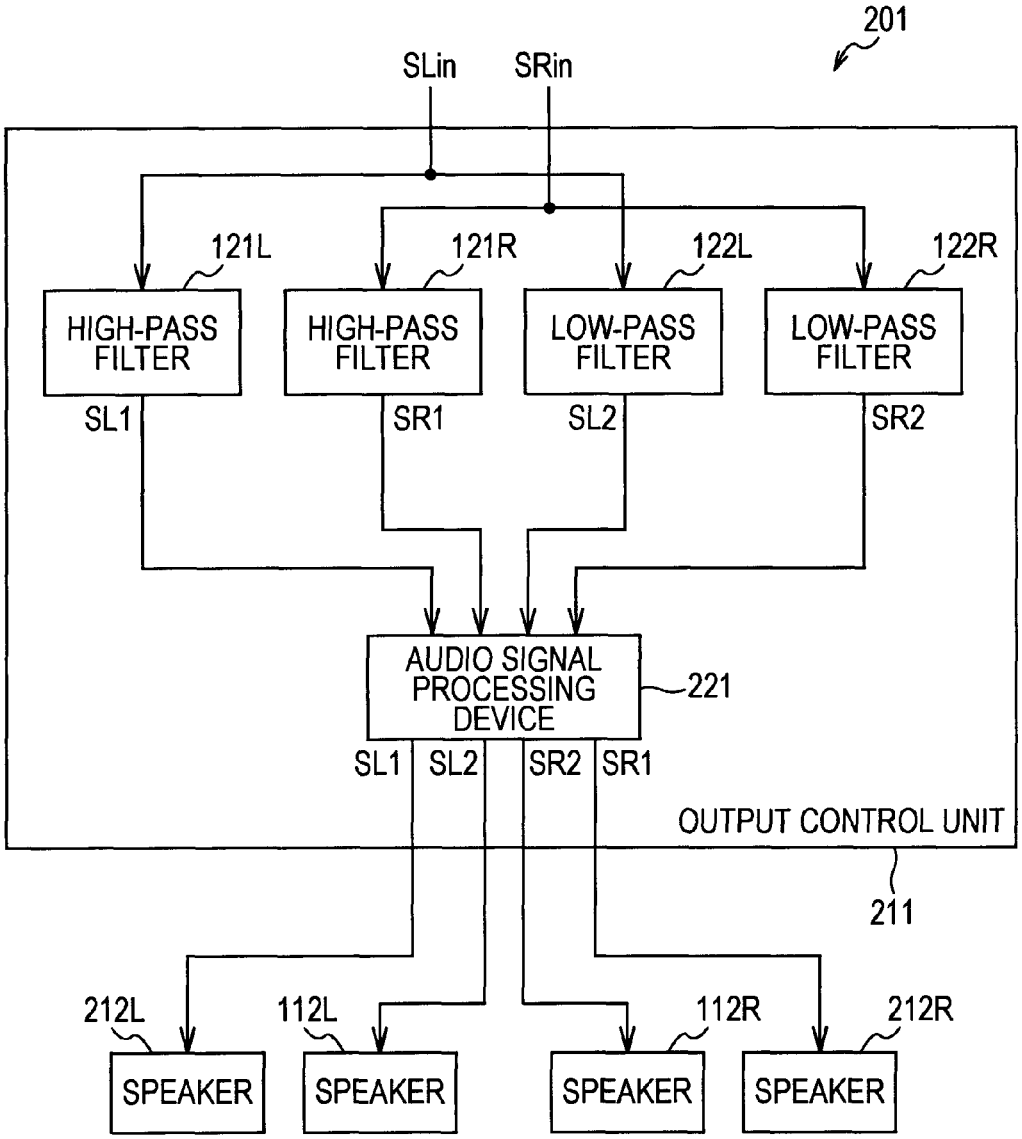
FIG. 8 is a block diagram that illustrates a second embodiment of the audio system to which the embodiments of the disclosure are applied.

FIG. 8 is a block diagram that illustrates a second embodiment of the audio system to which the embodiments of the disclosure are applied.

An audio system 201 of FIG. 8 is a system that uses actual speakers 212L and 212R instead of the virtual speakers 151L and 151R. Here, in the drawing, the portions that correspond to FIG. 1 have been given the same reference numerals, and portion with the same processes are appropriately omitted to avoid duplicate descriptions.

The audio system 201 is configured to include an audio signal processing device 211, speakers 112L and 112R, and the speakers 212L and 212R. Further, the speakers 112L and 112R are arranged on the same positions as with the audio system 101 and the speakers 212L and 212R are arranged on the same positions as the virtual speakers 151L and 151R of the audio system 101.

The audio signal processing device 211 is configured to include the high-pass filters 121L and 121R, the low-pass filters 122L and 122R, and an output control unit 221.

The output control unit 221 outputs the audio signal SL1 that is supplied from the high-pass filter 121L to the speaker 212L, and outputs the audio signal SR1 that is supplied from the high-pass filter 121R to the speaker 212R. Further, the output control unit 221 outputs the audio signal SL2 that is supplied from the low-pass filter 122L to the speaker 112L and outputs the audio signal SR2 that is supplied from the low-pass filter 122R to the speaker 112R.

The speaker 112L outputs sounds that are based on the audio signal SL2 and the speaker 112R outputs sounds that are based on the audio signal SR2. Accordingly, low-mid-pass sounds that are extracted from the low-pass filters 122L and 122R are output from the speakers 112L and 112R.

The speaker 212L outputs sounds that are based on the audio signal SL1 and the speaker 212R outputs sounds that are based on the audio signal SR1. Accordingly, high-pass sounds that are extracted from the high-pass filters 121L and 121R are output from the speakers 212L and 212R.

In so doing, similarly to the audio system 101, the sense of depth of sounds is able to be enriched.

3. Modified Examples

Modified examples of the embodiments of the disclosure will be described below.

Modified Example 1

The embodiments of the disclosure are also able to be applied in a case when processing an audio signal of a channel number that is greater than 2 channels. Here, in a case when an audio signal of a channel number that is greater than 2 channels is the processing target, the audio signal processing described above is not necessarily applied to all channels. For example, only applying the audio signal processing to 2 channel audio signals to the left and right on the front on the image side of a stereoscopic image when seen from the observer or applying the audio signal processing to 2.1 channel audio signals to the left and right and center on the front is considered.

Modified Example 2

Further, omitting the low-pass filters 122L and 122R from the audio signal processing device 111 and the audio signal processing device 211 is also possible. That is, sounds that are based on the audio signal SLin and the audio signal SRin may be output as are from the speakers 112L and 112R. In such a case, compared to a case when the low-pass filters 122L and 122R are provided, although there is a possibility that the audio image becomes slightly blurred, it is possible to enrich the sense of depth of sounds.

Modified Example 3

Furthermore, the bands of the audio signals that are extracted may be made to be changeable by using an equalizer or the like instead of the high-pass filters 121L and 121R and the low-pass filters 122L and 122R.

Here, the embodiments of the disclosure are able to be applied to devices that process and output audio signals such as, for example, a device that performs amplification or compensation of audio signals such as an audio amp or an equalizer, a device that performs reproduction or recording of audio signals such as an audio player or an audio recorded, or a device that performs reproduction or recording of image signals that include audio signals such as a video player or a video recorded. Further, the embodiments of the disclosure are able to be applied to systems that include the device described above such as, for example, a surround system.

[Configuration Example of Computer]

The series of processes of the audio signal processing device 111 and the audio signal processing device 211 described above may be executed by hardware or may be executed by software. In a case when executing the series of processes by software, a program that configures the software is installed on a computer. Here, the computer includes a computer in which dedicated hardware is built in, a genetic personal computer, for example, that is able to execute various types of functions by installing various types of programs, and the like.

Figure 9:
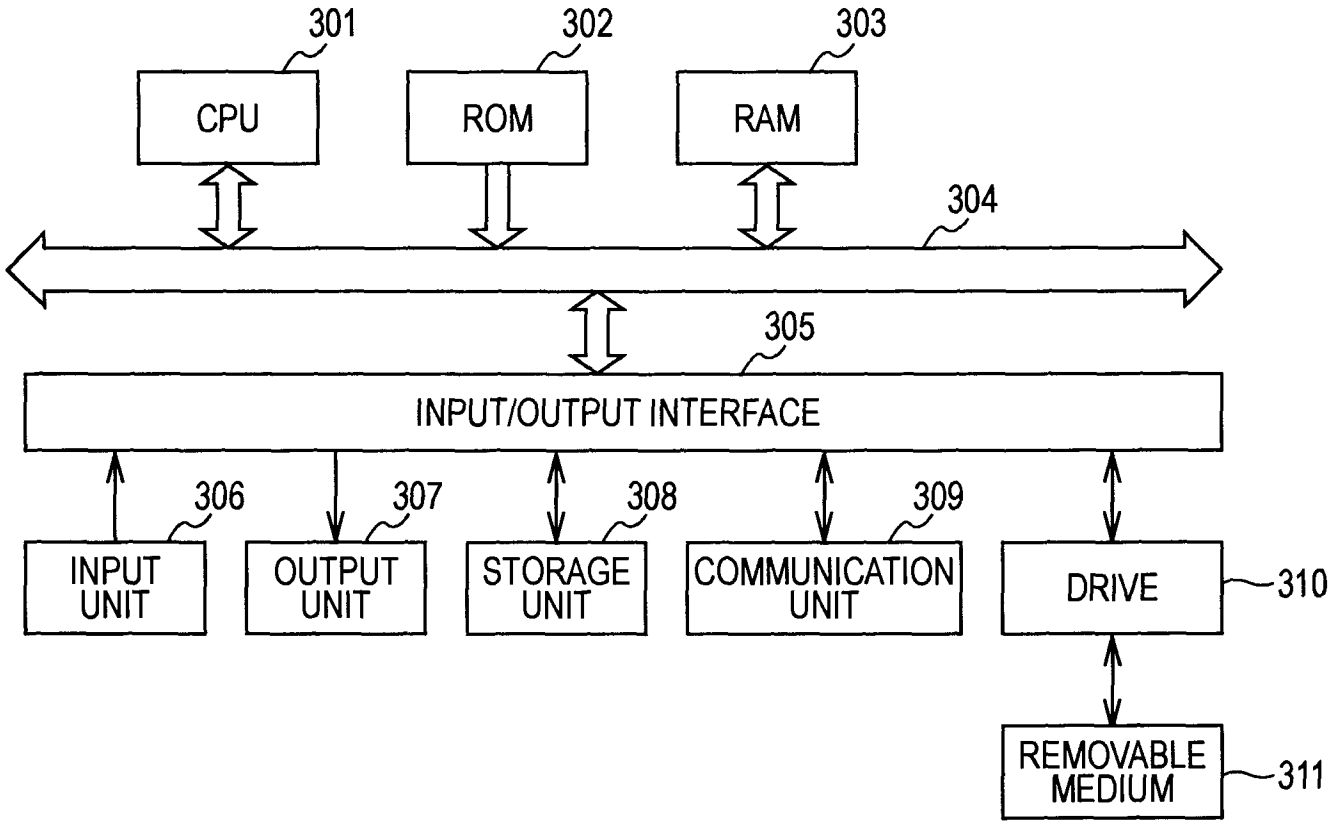
FIG. 9 is a block diagram that illustrates a configuration example of a computer.

FIG. 9 is a block diagram that illustrates a configuration example of hardware of a computer that executes the series of processes described above by a program.

In the computer, a CPU (Central Processing Unit) 301, a ROM (Read Only Memory) 302, and a RAM (Random Access Memory) 303 are connected to one another by a bus 304.

An input output interface 305 is further connected to the bus 304. An input unit 306, an output unit 307, a storage unit 308, a communication unit 309, and a drive 310 are connected to the input output interface 305.

The input unit 306 is composed of a keyboard, a mouse, a microphone, and the like. The output unit 307 is composed of a display, a speaker, and the like. The storage unit 308 is composed of a hard disk, a non-volatile memory, or the like. The communication unit 309 is composed of a network interface or the like. The drive 310 drives a removable medium 311 such as a magnetic disk, an optical disc, a magneto-optical disc, or a semiconductor memory.

In a computer that is configured as described above, the series of processes described above is performed by, for example, the CPU 301 loading a program that is stored in the storage unit 308 on the RAM 303 via the input output interface 305 and the bus 304 and executing the program.

A program that is executed by the computer (CPU 301) is able to be provided by being recorded on the removable medium 311 as, for example, a package medium or the like. Further, it is possible to provide the program via a wired or wireless transfer medium such as a local area network, the Internet, or digital satellite broadcasting.

In the computer, it is possible to install the program on the storage unit 308 via the input output interface 305 by causing the removable medium 311 to be fitted on the drive 310. Further, the program may be received by the communication unit 309 via a wired or wireless transfer medium and installed on the storage unit 308. Otherwise, the program may be installed on the ROM 302 or the storage unit 308 in advance.

Here, a program that the computer executes may be a program in which processes are performed in time series in the order described in the present specification, or may be a program in which the processes are performed at given timing such as in parallel or when there is a call.

Further, in the present specification, the term system has the meaning of an overall device that is configured by a plurality of devices, sections, and the like.

Furthermore, the embodiments of the disclosure are not limited to the embodiments described above, and various modifications are possible without departing from the scope of the disclosure.

The present disclosure contains subject matter related to that disclosed in Japanese Priority Patent Application JP 2010-280165 filed in the Japan Patent Office on Dec. 16, 2010, the entire contents of which are hereby incorporated by reference.

What is claimed is:

1. An audio system comprising:

a first speaker and a second speaker that are arranged in front of a predetermined listening position to be substantially bilaterally symmetrical with respect to the listening position;

a first attenuator that attenuates components that are equal to or less than a predetermined first frequency of an input audio signal;

a signal processor that generates, based on the components attenuated by the first attenuator, signals correlated with a first virtual speaker output location and a second virtual speaker output location that are arranged in front of the predetermined listening position to be substantially bilaterally symmetrical with respect to the listening position such that, with the listening position being a center, a center angle that is formed by connecting the listening position with each of the first virtual speaker output location and the second virtual speaker output location is greater than a center angle that is formed by connecting the listening position with the first speaker and the second speaker, and the first virtual speaker output location and the second virtual speaker output location are positioned to be closer in a longitudinal direction of the listening position to the listening position than the first speaker and the second speaker; and an output controller that controls to output, from the first speaker and the second speaker, sounds that are based on the input audio signal, and to output for reproduction as emanating from the first virtual speaker output location and from the second virtual speaker output location, sounds that are based on a first audio signal in which components that are equal to or less than the first frequency of the input audio signal have been attenuated, wherein the sounds that are output for reproduction as emanating from the first virtual speaker output location and from the second virtual speaker output location are generated based on respective audio signals obtained by superimposing respective head-related transfer functions on the attenuated input audio signal, and wherein the respective head-related transfer functions are superimposed on the attenuated input audio signal such that the sounds that are output for reproduction have a ratio between direct audio signals and indirect audio signals determined based on a distance in the longitudinal direction from the listening position to the first virtual speaker output location and to the second virtual speaker output location.

2. The audio system according to claim 1, further comprising:

a second attenuator that attenuates components that are equal to or greater than a predetermined second frequency of the input audio signal, wherein the output controller controls to output, from the first speaker and the second speaker, sounds that are based on a second audio signal in which components that are equal to or greater than the second frequency of the input audio signal have been attenuated.

3. The audio system according to claim 1, wherein the first speaker, second speaker, first virtual speaker output location, and second virtual speaker output location are arranged such that the distance between the first virtual speaker output location and the listening position and the distance between the second virtual speaker output location and the listening position are less than the distance between the first speaker and the listening position or the distance between the second speaker and the listening position.

4. The audio system according to claim 1, wherein the signal processor performs predetermined signal processing with respect to the first audio signal in generating the correlated signals, which when reproduced by the first speaker and the second speaker, causes the first speaker and the second speaker to output sounds that appear to a person at the listening position to virtually emanate from the first virtual speaker output location and from the second virtual speaker output location.

5. The audio system according to claim 1, wherein the head-related transfer functions comprises a first head-related transfer function HLL and a second head-related transfer function HLR, wherein an audio signal SL1Rb that corresponds to direct sounds reaching a right ear of a listener at the listening position is determined based on the following equation:

$$SL1Rb[n] = \sum_{m=0}^{dLR} (SL1[n-m] * HLR[m])$$

where n is a number of samples, SL1 represents the attenuated input audio signal for the left ear of the listener at the listening position, dLR represents a next number of the head-related transfer function HLR, and wherein an audio signal SL1Lb that corresponds to direct sounds reaching a left ear of a listener at the listening position is determined based on the following equation:

$$SL1Lb[n] = \sum_{m=0}^{dLL} (SL1[n-m] * HLL[m])$$

where dLL represents a next number of the head-related transfer function HLL.

6. An audio signal processing device comprising:

an attenuator that attenuates components of an input audio signal that are equal to or less than a predetermined frequency; and an output controller that controls to output, from a first speaker and a second speaker, sounds that are based on the input audio signal, and to output for reproduction as emanating from a first virtual speaker output location and from a second virtual speaker output location, sounds that are based on an audio signal in which components that are equal to or less than the predetermined frequency of the input audio signal are attenuated, wherein the first speaker and the second speaker are arranged in front of a predetermined listening position to be substantially bilaterally symmetrical to the listening position, wherein the first virtual speaker output location and the second virtual speaker output location are arranged in front of the listening position to be substantially bilaterally symmetrical with respect to the listening position such that, with the listening position being a center, a center angle that is formed by connecting the listening position with the first virtual speaker output location and the second virtual speaker output location is greater than a center angle that is formed by connecting the listening position with the first speaker and the second speaker, and the first virtual speaker output location and the second virtual speaker output location are positioned to be closer in a longitudinal direction of the listening position to the listening position than the first speaker and the second speaker, and wherein the sounds that are output for reproduction as emanating from the first virtual speaker output location and from the second virtual speaker output location are generated based on respective audio signals obtained by superimposing respective head-related transfer functions on the attenuated input audio signal, and wherein the respective head-related transfer functions are superimposed on the attenuated input audio signal a such that the sounds that are output for reproduction have a ratio between direct audio signals and indirect audio signals determined based on a distance in the longitudinal direction from the listening position to the first virtual speaker output location and to the second virtual speaker output location.

7. The audio signal processing device according to claim 6, wherein the head-related transfer functions comprises a first head-related transfer function HLL and a second head-related transfer function HLR, wherein an audio signal SL1Rb that corresponds to direct sounds reaching a right ear of a listener at the listening position is determined based on the following equation:

$$SL1Rb[n] = \sum_{m=0}^{dLR} (SL1[n-m] * HLR[m])$$

where n is a number of samples, SL1 represents the attenuated input audio signal for the left ear of the listener at the listening position, dLR represents a next number of the head-related transfer function HLR, and wherein an audio signal SL1Lb that corresponds to direct sounds reaching a left ear of a listener at the listening position is determined based on the following equation:

$$SL1Lb[n] = \sum_{m=0}^{dLL} (SL1[n-m] * HLL[m])$$

where dLL represents a next number of the head-related transfer function HLL.

8. An audio signal processing method comprising:

attenuating components of an input audio signal that are equal to or less than a predetermined frequency; and controlling to output, from a first speaker and a second speaker, sounds that are based on the input audio signal, and to output for reproduction as emanating from a first virtual speaker output location and from a second virtual speaker output location, sounds that are based on an audio signal in which components that are equal to or less than the predetermined frequency of the input audio signal are attenuated, wherein the first speaker and the second speaker are arranged in front of a predetermined listening position to be substantially bilaterally symmetrical to the listening position, wherein the first virtual speaker output location and the second virtual speaker output location are arranged in front of the listening position to be substantially bilaterally symmetrical with respect to the listening position such that, with the listening position being a center, a center angle that is formed by connecting the listening position with the first virtual speaker output location and the second virtual speaker output location is greater than a center angle that is formed by connecting the listening position with the first speaker and the second speaker, and the first virtual speaker output location and the second virtual speaker output location are positioned to be closer in a longitudinal direction of the listening position to the listening position than the first speaker and the second speaker, and wherein the sounds that are output for reproduction as emanating from the first virtual speaker output location and from the second virtual speaker output location are generated based on respective audio signals obtained by superimposing respective head-related transfer functions on the attenuated input audio signal, and wherein the respective head-related transfer functions are superimposed on the attenuated input audio signal such that the sounds that are output for reproduction have a ratio between direct audio signals and indirect audio signals determined based on a distance in the longitudinal direction from the listening position to the first virtual speaker output location and to the second virtual speaker output location.

9. The audio signal processing method according to claim 8, wherein the head-related transfer functions comprises a first head-related transfer function HLL and a second head-related transfer function HLR, wherein an audio signal SL1Rb that corresponds to direct sounds reaching a right ear of a listener at the listening position is determined based on the following equation:

$$SL1Rb[n] = \sum_{m=0}^{dLR} (SL1[n-m] * HLR[m])$$

where n is a number of samples, SL1 represents the attenuated input audio signal for the left ear of the listener at the listening position, dLR represents a next number of the head-related transfer function HLR, and wherein an audio signal SL1Lb that corresponds to direct sounds reaching a left ear of a listener at the listening position is determined based on the following equation:

$$SL1Lb[n] = \sum_{m=0}^{dLL} (SL1[n-m] * HLL[m])$$

where dLL represents a next number of the head-related transfer function HLL.

10. A non-transitory computer-readable medium having embodied thereon a program, which when executed by a computer causes the computer to execute a process of:

attenuating components of an input audio signal that are equal to or less than a predetermined frequency; and controlling to output, from a first speaker and a second speaker, sounds that are based on the input audio signal, and to output for reproduction as emanating from a first virtual speaker output location and from a second virtual speaker output location, sounds that are based on an audio signal in which components that are equal to or less than the predetermined frequency of the input audio signal are attenuated, wherein the first speaker and the second speaker are arranged in front of a predetermined listening position to be substantially bilaterally symmetrical to the listening position, wherein the first virtual speaker output location and the second virtual speaker output location are arranged in front of the listening position to be substantially bilaterally symmetrical with respect to the listening position such that, with the listening position being a center, a center angle that is formed by connecting the listening position with the first virtual speaker output location and the second virtual speaker output location is greater than a center angle that is formed by connecting the listening position with the first speaker and the second speaker, and the first virtual speaker output location and the second virtual speaker output location are positioned to be closer in a longitudinal direction of the listening position to the listening position than the first speaker and the second speaker, and wherein the sounds that are output for reproduction as emanating from the first virtual speaker output location and from the second virtual speaker output location are generated based on respective audio signals obtained by superimposing respective head-related transfer functions on the attenuated input audio signal, and wherein the respective head-related transfer functions are superimposed on the attenuated input audio signal such that the sounds that are output for reproduction have a ratio between direct audio signals and indirect audio signals determined based on a distance in the longitudinal direction from the listening position to the first virtual speaker output location and to the second virtual speaker output location.

11. The non-transitory computer-readable medium according to claim 10, wherein the head-related transfer functions comprises a first head-related transfer function HLL and a second head-related transfer function HLR, wherein an audio signal SL1Rb that corresponds to direct sounds reaching a right ear of a listener at the listening position is determined based on the following equation:

$$SL1Rb[n] = \sum_{m=0}^{dLR} (SL1[n-m] * HLR[m])$$

where n is a number of samples, SL1 represents the attenuated input audio signal for the left ear of the listener at the listening position, dLR represents a next number of the head-related transfer function HLR, and wherein an audio signal SL1Lb that corresponds to direct sounds reaching a left ear of a listener at the listening position is determined based on the following equation:

$$SL1Lb[n] = \sum_{m=0}^{dLL} (SL1[n-m] * HLL[m])$$

where dLL represents a next number of the head-related transfer function HLL.

* * * * *